US005688384A

United States Patent [19]

Hodgson et al.

[11] Patent Number: 5,688,384

[45] Date of Patent: Nov. 18, 1997

[54] FLUORINE CELL

[75] Inventors: Graham Hodgson; Martin P. Hearne, both of Preston, United Kingdom

[73] Assignee: British Nuclear Fuels PLC, Cheshire, United Kingdom

[21] Appl. No.: 624,409

[22] PCT Filed: Sep. 11, 1995

[86] PCT No.: PCT/GB95/02145

§ 371 Date: May 14, 1996

§ 102(e) Date: May 14, 1996

[87] PCT Pub. No.: WO96/08589

PCT Pub. Date: Mar. 21, 1996

[30] Foreign Application Priority Data

Sep. 14, 1994 [GB] United Kingdom ..... 9418598

[51] Int. Cl.[6] ..... C25B 9/00; C25B 11/12

[52] U.S. Cl. ..... 204/229; 204/266; 204/286; 204/290 R; 204/294; 204/241; 204/247

[58] Field of Search ..... 204/290 R, 294, 204/286, 229, 263, 266, 247, 241, 278

[56] References Cited

U.S. PATENT DOCUMENTS

| | | | |
|---|---|---|---|
| 3,616,436 | 10/1971 | Haas . | |
| 3,773,644 | 11/1973 | Tricoli et al. | 204/294 X |
| 4,002,552 | 1/1977 | Bunn, Jr. et al. . | |
| 4,144,161 | 3/1979 | Bourgeois | 204/229 |
| 5,037,518 | 8/1991 | Young et al. | 204/229 X |
| 5,154,813 | 10/1992 | Dill | 204/286 |
| 5,160,415 | 11/1992 | Kondo et al. | 204/294 X |
| 5,290,413 | 3/1994 | Bauer et al. | 204/286 X |

FOREIGN PATENT DOCUMENTS

| | | |
|---|---|---|
| 0 424 727 | 5/1991 | European Pat. Off. . |
| 0534081 | 3/1993 | European Pat. Off. . |
| 2135334 | 8/1984 | United Kingdom . |

*Primary Examiner*—Donald R. Valentine
*Attorney, Agent, or Firm*—Oliff & Berridge

[57] ABSTRACT

An on-demand fluorine cell is described together with the construction of a suitable anode and a means of mounting the anode within the cell. The fluorine cell comprises a cell container having a cathode compartment and an anode compartment, the anode compartment having an anode therein, the cathode compartment and the anode compartment having separation means therebetween so as to separate fluorine gas and hydrogen gas generated during operation of said fluorine cell but said separation means allowing passage of electrolyte between said compartments; said anode extending below a lower end of the separation means and being continuously in contact with the electrolyte, control sensor means in at least one of said compartments to sense the level of electrolyte in said at least one compartment; electric current supply means responsive to signals from said control sensor means so as to either start or stop current supply in accordance with said signals.

15 Claims, 3 Drawing Sheets

FIG.2
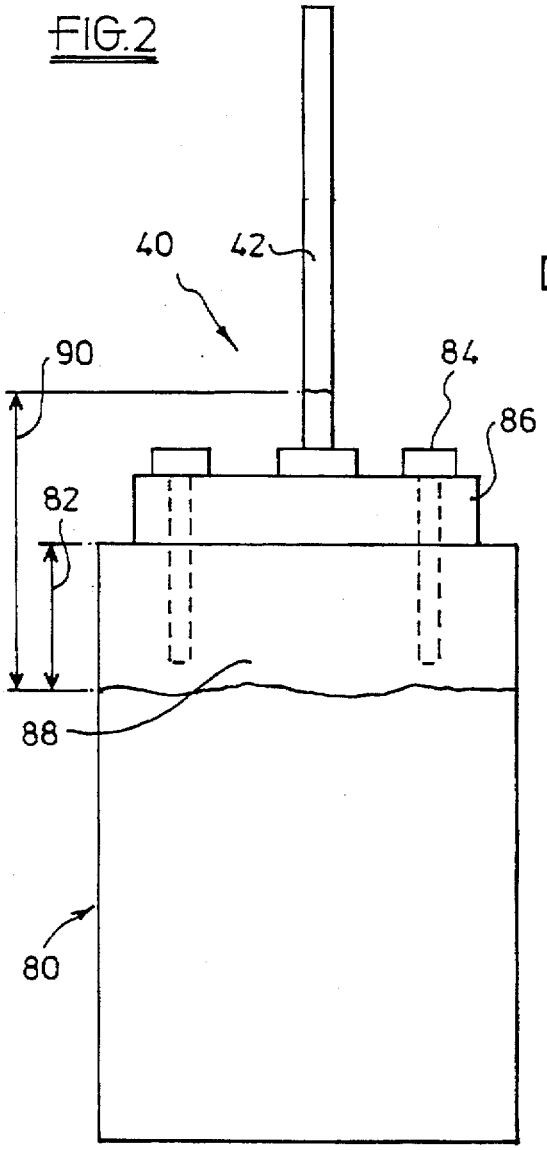
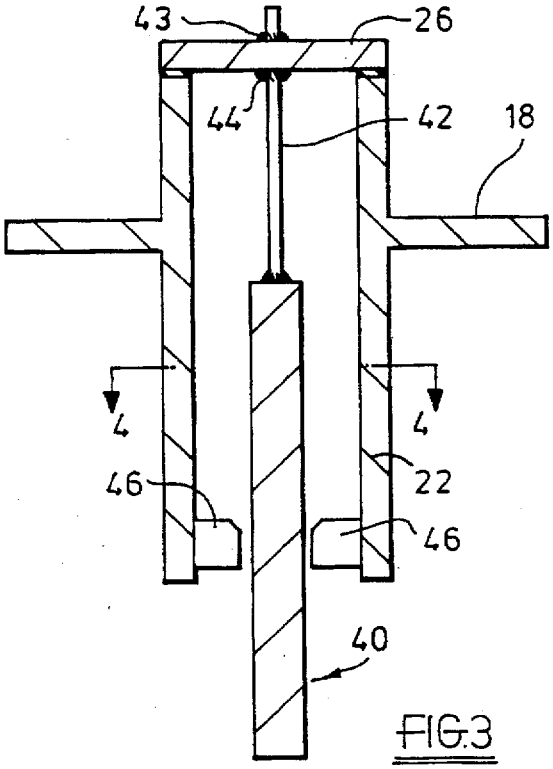
FIG.3
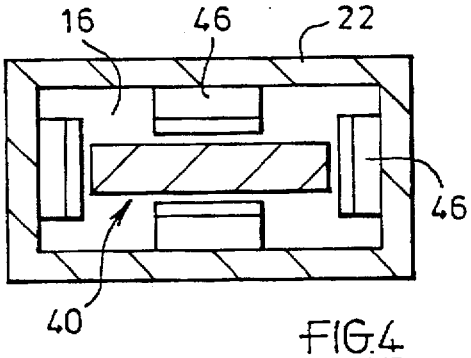
FIG.4

FLUORINE CELL

The present invention relates to a fluorine cell and particularly, though not exclusively, to an on-demand type of fluorine cell for the production of fluorine gas.

Electrochemical cells for the production of fluorine are known in the art. Many large-scale fluorine producing cells and employing currents in the region of 1000 amps and above are operated substantially continuously or at least have the hydrogen fluoride electrolyte maintained in a permanently molten condition to prevent damage to the electrodes on freezing. Such fluorine producing plants are used for supplying fluorine to large-scale production processes which are normally operated continuously and where the fluorine production rate can be accurately matched to the demand.

A particular problem arises when small-scale production cells are contemplated using production currents of less than about 1000 amps and where the fluorine demand is intermittent and/or cannot be accurately predicted. Such users frequently require fluorine at irregular intervals and in relatively small quantities. Examples of such use may be research environments such as in Universities or in industrial research laboratories. If the cell is shut down after each use, lengthy start-up procedures are usually required to generate fluorine again which gives rise to inconvenience and inefficiency.

Frequently, conventional small-scale fluorine cells are simply left running between uses so as to ensure a prompt fluorine supply. An on-line lute pot or seal pot sometimes being employed. Thus, fluorine and consequently hydrogen fluoride electrolyte is wasted due to the necessity of blowing-off fluorine.

Conventional fluorine cells tend to be either troublesome or wasteful, due to the difficulties in matching fluorine output to need. If the cell is set below the fluorine needs of the process, insufficient fluorine is produced, and if the output is set above the process requirement, fluorine is wasted due to blow-off. Due to these difficulties many users opt for their supply of fluorine in pressurised cylinders.

Another problem which arises with known cells is in the construction of their anodes which are generally made from hard carbon which is attached to an anode hanger by means of copper pressure plates which sandwich the carbon therebetween by means of bolts. This method had been found to be unreliable due to corrosion products degrading the electrical contact between the carbon anode and copper pressure plates.

A further problem which arises is that generally known as stud-fires and stud-leaks. Known cells have their anode hangers passing through the cell lid and insulated therefrom by plastics material seals. A considerable amount of heat can be generated during operation of a fluorine cell due to the passage of electrical current and the resultant resistance heating. This problem can also be exacerbated by the above noted problem of poor electrical contact between the anode and anode connector or hanger. Such heating greatly increases the chances of a runaway reaction between the seal material, often a fluoroelastomer rubber, and the generated fluorine, thus causing a fluorine leak. In extreme cases, the seal and the metal of the electrical connection stud actually burn in the stream of fluorine gas producing a stud-fire.

A yet further problem with known fluorine cells is that of ensuring accurate vertical alignment of the anode within the anode compartment so as to guarantee even separation of anode and cathode and, in the extreme case, that no electrical contact whatsoever is made with the surrounding cell walls which may constitute the cell cathode. A consequential problem of the inaccuracy of anode mounting with known cells is that fluorine bubbles sometimes find their way into the hydrogen side of the cell and results in a violent reaction during recombination of the fluorine and hydrogen.

GB 1 561 212 describes a hydrogen generating cell by the electrolysis of water, the generation of hydrogen being controlled merely by the pressure thereof depressing the water level below the level of the cathodes so as to terminate electrolysis. This is not practicable with a fluorine cell due to the very low conductivity of the electrolyte giving rise to very high resistance between anode and cathode exacerbated by excessive path length.

EP-0150 285 A1 describes a fluorine generating cell but is constructed for continuous supply of fluorine.

It is an object of the present invention to produce an on-demand fluorine cell which overcomes the above specified problems of waste and/or inconvenience of use.

It is a further object of the present invention to provide an anode construction which is more reliable than known constructions.

It is a yet further object is to provide an improved means of securing the anode within the cell.

It is yet another object of the present invention to provide a cell construction such that the stud-leaks and stud-fires are obviated.

According to a first aspect of the present invention there is provided a fluorine cell for the production of fluorine, the fluorine cell comprising: a cell container having a cathode compartment and an anode compartment, the anode compartment having an anode therein, the cathode compartment and the anode compartment having separation means therebetween so as to separate fluorine gas and hydrogen gas generated during operation of said fluorine cell but said separation means allowing passage of electrolyte between said compartments; said anode extending below a lower end of the separation means and being continuously in contact with the electrolyte; control sensor means in at least one of said compartments to sense the level of electrolyte in said at least one compartment; electric current supply means responsive to signals from said control sensor means so as to either start or stop current supply in accordance with said signals.

In particular, the cell is suited to on-demand production of fluorine gas but may also be used to generate other gases by changing the electrolyte. For example, nitrogen trifluoride can be generated by using an ammonium fluoride based electrolyte. Therefore, any reference to fluorine in this specification is to be taken as a reference to other appropriate gases which may also be generated by changing the electrolyte.

The separation means may be a skirt member which extends below the surface of the electrolyte within the cell such that there are produced two separate compartments; an anode compartment and a cathode compartment; above the electrolyte surface. The compartments are capable of withstanding significant hydrogen or fluorine gas pressure. The compartments above the electrolyte surface may be sealed and have means communicating therewith to allow either fluorine or hydrogen as desired to be vented or extracted for whatever purpose. Such means many comprise conduits and valves for example.

The cell container may have heating means so as to be able to heat the electrolyte therein to render it molten. Such heating means may comprise electrical resistance heating or steam, for example.

The cathode may be provided by virtue of the cell container per se or may be separately provided within said cell container.

The control sensor means may comprise at least one sensor so as to control a device which controls electrolysis, i.e. a device which controls the supply of electric current to the electrolyte. The sensor means may comprise a probe which extends into the anode compartment, for example, and produces a signal in response to the level of the electrolyte surface. The probe can be of any suitable form and may be selected from those that depend on electrical continuity or contact, capacitance or on optical transducer means to read the electrolyte level in the anode compartment.

The anode compartment has an anode therein, at least the lower end of which extends below the lowest extremity of the separation means and is thus, continuously at least partially immersed in the electrolyte. The anode extends below the lower extremity of the separation means so as to provide minimum path length between anode and cathode.

As fluorine is produced in the anode compartment and is lead away for use, the electrolyte level may remain substantially constant. However, if the extraction of fluorine from the cell is stopped, the generation thereof continues and the pressure of fluorine in the cell anode compartment increases with the result that the level of the electrolyte surface in the anode compartment is depressed. This continues until a point at which the sensor means is preset to produce a signal, in response to which the electrolysis controlling device stops the supply of current to the cell, and electrolysis is stopped and the fall in surface level of the electrolyte also stops. When fluorine withdrawal from the anode compartment is again initiated for whatever reason, the electrolyte level in the anode compartment begins to rise as the fluorine pressure in the anode compartment falls. The sensor means then detects the rising surface level and electrolysis is again started in response to the signal from the sensor means to the electrolysis controlling device. At no time is the anode removed from contact with the electrolyte due to the depressed surface level thereof.

Thus, a particular advantage of the present invention is that the anode compartment may provide a fluorine reservoir and that the rate of fluorine production may be set somewhat above that actually required since the supply will automatically turn itself on and off in response to signals from the sensor means in response to rising and falling electrolyte surface level. In prior art cells, the fluorine production rate had to be accurately controlled by precise current level control or the cell would over- or under-produce depending upon the rate of fluorine extraction from the cell. The cell of the present invention is substantially self-regulating and does not waste fluorine or hydrogen fluoride by unnecessary blowing-off.

The sensor means also provides a fail-safe protection for the cell. If the fluorine pressure should inadvertently rise due to a downstream blockage, for example, the sensor will cut off the current supply and thus stop electrolysis. With conventional cells, in extreme cases, it has been known for fluorine and hydrogen gas to react within the cell due to one or the other bubbling into the other compartment. Such occurrences are extremely dangerous and the fail-safe nature of the cell of the present invention is a particular advantage.

Another particular advantage of the fluorine cell of the present is its ability to produce fluorine at a desired pressure. This is due to the fact that the fluorine gas pressure in the anode compartment results from the height difference between the electrolyte in the anode compartment and in the cathode compartment. Preferably, the hydrogen, or cathode, compartment may always be operated at atmospheric pressure (or slightly above) for safety reasons. Therefore, the maximum fluorine gas pressure for a given cell construction may be controlled by the position at which the sensor means is preset to read the electrolyte surface level, i.e. the level at which electrolysis is automatically shut off. Therefore, once the fluorine production rate is set above actual plant demand, the fluorine gas will be safely maintained at a predetermined pressure.

The maximum pressure which may be attained will be governed by the depth to which the separation member extends into the electrolyte. In one embodiment of the present invention, a fluorine cell has been constructed with a skirt member extending 600 mm below the electrolyte surface giving a fluorine gas pressure of 1000 mm water gauge. Such a cell having fluorine at elevated pressure has operated safely and reliably due to the presence of the level detecting sensors controlling the electrolysis. Operation of the cell at raised fluorine pressure without the level detecting sensors would be hazardous due to the explosive nature of the recombination of fluorine and hydrogen.

In a preferred embodiment of the present invention, there may be provided a second sensor means to detect a maximum electrolyte surface level in the anode compartment. The second sensor means may also be used as a fail-safe device in the case where, for some reasons, excessive hydrogen pressure is being developed in the cathode compartment and is forcing the electrolyte level in the anode compartment to rise. Once the second sensor means detects the electrolyte level at the maximum permitted height within the anode compartment, the device controlling electrolysis will again shut off the current supply. In this case hydrogen will cease to be produced and is prevented from finding its way into the anode compartment and causing a violent reaction with the fluorine gas.

The first and second sensor means may both work on the same physical principles or on different principles. For example, one sensor may be an electrical continuity sensor whilst the second sensor may be a pressure transducer.

The first and second sensor means may be situated either within the anode compartment or within the cathode compartment so as to read electrolyte surface level. It will be appreciated that as the electrolyte level in one compartment rises, the level in the other compartment will fall and vice versa.

According to a second aspect of the present invention there is provided an anode construction for a fluorine cell, said anode comprising a carbon anode portion, said anode portion having a metallic hanger portion attached thereto by fixing means and a coating of a metal applied to at least the area in the region of the junction between said anode portion and said hanger portion.

Preferably, the carbon anode comprises a substantially non-porous, low permeability carbon, for example carbon grade FE-5 (Trade name) produced by the Toyo Tanso Carbon Company, Japan or YBD (Trade name) type carbon produced by Union Carbide Corp, U.S.A.

The hanger portion may be attached to the anode portion by mechanical means such as bolts or screws, for example, the anode portion being, for example, tapped to receive a screw thread.

The area of the junction between the hanger portion and the anode portion is coated with a metal which may be substantially the same metal as that of the hanger portion or may be a different metal. In one embodiment of the present invention, the hanger portion may be made of nickel or a nickel-based alloy and the coating may also be nickel or a nickel-based alloy. However, any metal known in the art to be suitable for the purpose may be employed.

The coating which is applied to the junction between the anode portion and the hanger portion is preferably applied by a physical vapour deposition technique such as flame- or plasma-spraying, for example. Alternatively, the coating may be applied by chemical vapour deposition methods.

A further treatment may be applied to the region of the carbon anode portion which is to receive the metal coating. Such treatment may include a surface treatment such as roughening by mechanically abrading or by a suitable chemical etching treatment. Alternatively, a pattern of grooves with width and depth in the range 0.5–5 mm may be used. For example, a square grid pattern of grooves 1 mm wide by 3 mm deep on a pitch of 3 mm is machined into a suitable carbon block. This provides a good key for the next stage of the process. The treated area may then be treated as by the application of an intermediate coating such as pitch, for example, which may be applied by techniques such as dipping, brushing or spraying. Such intermediate coatings may be heat treated so as to drive off volatile constituents or to chemically affect the coating such as by heating under a reducing atmosphere, for example.

It has been found that anodes produced according to the second aspect of the present invention give improved electrical contact and are not susceptible to electrical degradation due to corrosion products produced between the carbon and the metal hanger.

According to a third aspect of the present invention there is provided an anode mounting arrangement within an anode compartment of a fluorine cell, the arrangement comprising an anode portion having flexible hanger means connected thereto, said flexible hanger means being connected to a wall of said anode compartment so as to allow movement between said anode and the walls of said anode compartment and electrically insulating guide members interposed between said anode and said walls.

According to a feature of the third aspect of the present invention, the flexible hanger means may be connected to an inner surface of the anode compartment by a method such as, for example, welding whereby no through-hole is produced in the wall of the anode compartment, an electrical connection stud being connected by suitable means such as, for example, welding on the anode compartment outer surface. This arrangement obviates the occurrence of stud-leaks and stud-fires since there is no need to provide sealing means at this point and neither is there a hole through which fluorine can leak at the anode attachment point.

The flexible anode hanger may comprise a metal rod such as a mild steel material. However, any other suitable metal may be used. The term "flexible" is used to denote the ability of the anode to deflect so as to be able to accommodate any movement or dimensional inaccuracies between the carbon portion and the insulating guide members.

The electrically insulating guide members may preferably comprise wholly or partially fluoro-plastics materials, for example, such that the anode with the flexible hanger member becomes self aligning within the anode compartment of the fluorine cell. Alternatively, ceramic materials such as alumina for example may be employed, provided that such ceramic guides are positioned such that they do not become wetted by the liquid electrolyte.

Such guide members may be attached to the wall or walls of the anode compartment. Alternatively, the guide members may be attached to the anode member itself, to cathode plates or to the base of the cell. The best position may be dependant upon the internal geometry of each particular cell.

The anode compartment may be rectangular in cross section, in which case the guide members may be attached preferably, to each wall. The anode compartment may alternatively be substantially circular in cross section, in which case, the guide member may be either circular or may comprise two or more arc-shaped segments.

Guide members may be situated at one axial position and be of relatively long axial length or may be placed at two axial levels and be, for example, relatively shorter in axial length.

The guide members have been found to maintain electrical insulation between the anode and anode compartment wall. A particular advantage of the mounting structure of the present invention is that it has been found possible to allow the electrolyte to freeze without damage being caused to the anode by contraction effects. The flexible hanger means allows some movement of the anode relative to the anode compartment walls such that shrinkage of the electrolyte during freezing may be automatically compensated; and, the insulation members prevent any possible contact between the anode itself and the anode compartment walls.

In order that the present invention may be more fully understood, examples will now be described by way of illustration only with reference to the accompanying drawings, of which:

FIG. 2 shows a schematic view of an anode according to the present invention;

FIG. 3 shows a cross section through the anode compartment of FIG. 1 along the line 3—3;

FIG. 4 shows a cross section through the anode of FIG. 3 along the line 4—4.

Figure 1:
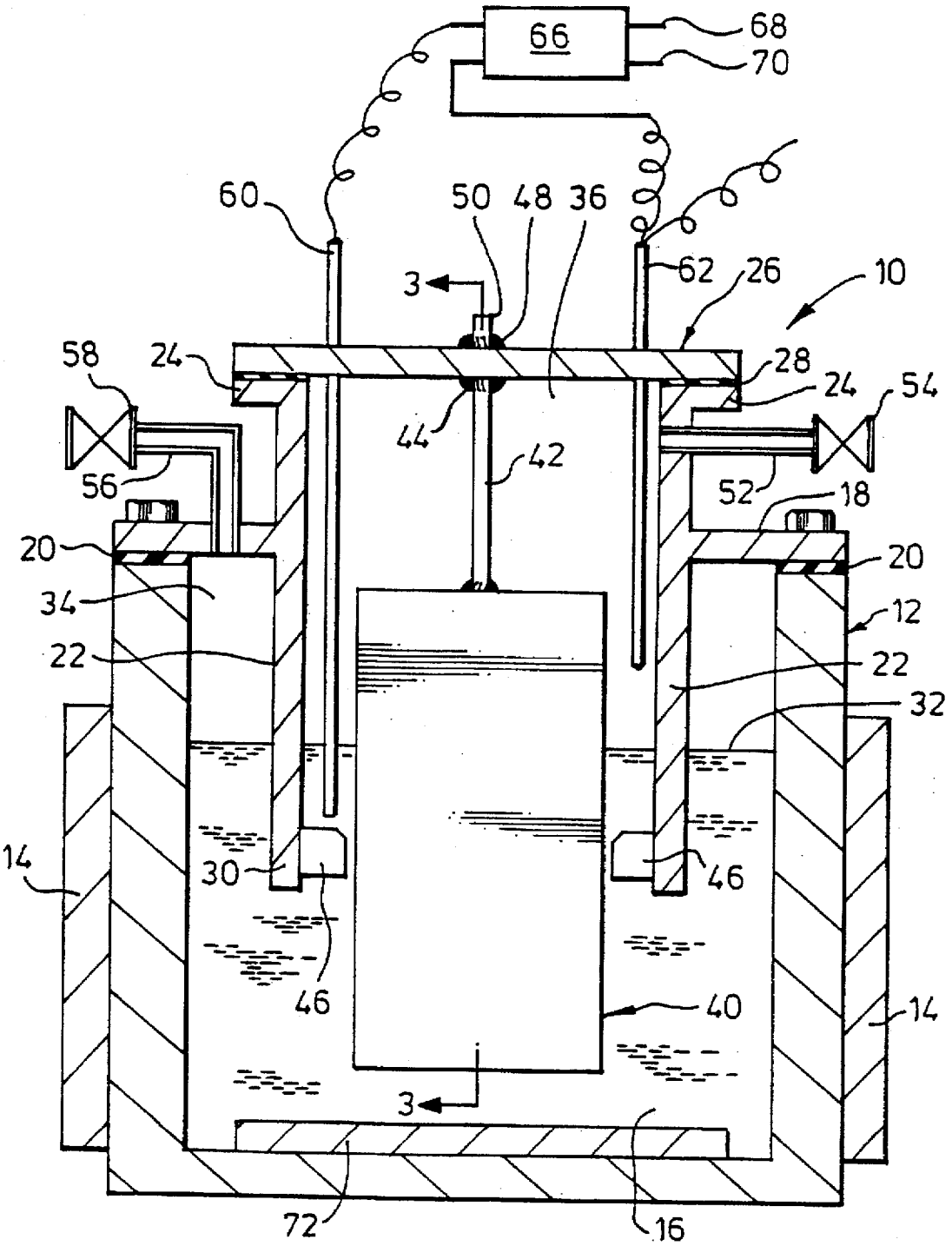
FIG. 1 shows a cross section through a schematic diagram of a fluorine cell according to the present invention.

Referring now to the drawings and where the same features are denoted by common reference numerals.

In FIG. 1 a cross section through a schematic diagram of a fluorine cell according to the present invention is shown generally at 10. The cell comprises a cell container 12 of mild steel construction, the cell container being cathodic. The cell container is provided with an electrical resistance heating jacket 14 for melting the electrolyte 16 within the cell. To the top of the cell container is fixed a sealing plate 18 which is insulated from the cathodic cell container by an insulating and sealing member 20. An electrically neutral skirt member 22 made of, in this case, Monel (Trade mark) metal depends from the plate 18 and also extends upwardly therefrom to a flange member 24. A sealing lid member 26 is fixed to the flange 24 but is insulated therefrom by a sealing and insulating member 28, the lid 26 being anodic. The skirt member 22 extends downwardly and has its end 30 immersed in the electrolyte 16 so as to form two distinct chambers above the level 32 of the electrolyte; a cathode compartment or hydrogen chamber 34 and an anode compartment or fluorine gas chamber 36 which are separated from each other by the skirt member 22 and the electrolyte surface 32. Within the anode compartment 36 is an anode, shown generally at 40, and suspended from the sealing lid 26 by a flexible anode hanger 42 in the form of a mild steel rod which is welded 44 to the underside of the lid 26 (the construction of the anode 40 will be dealt with below in more detail with reference to FIG. 2). The anode extends below the end 30 of the skirt member 22. Attached to the wall on the anode compartment 36 side of the skirt 22 are anode guide blocks 46 of fluoro-plastics material which maintain the anode 40 substantially central within the anode compartment 36 and prevent contact of the anode 40 with the skirt 22. On the outer surface of the lid member is welded 48 an anode connector stud 50, thus, there is no through-hole provided in the lid member 26. In the upper portion of the fluorine chamber 36 is an outlet conduit 52 having a valve 54. Similarly, in the upper portion of the cathode compartment is a conduit 56 having a valve 58. Continuity sensor probes 60, 62 are provided to detect minimum and maximum heights of the electrolyte level 32, respectively. The probes are connected to a device 66 which starts and stops electrolysis in response to signals from the probes by providing a power supply indicated at 68,70 to the anode and cathode of the cell.

A PTFE base layer 72, is fixed to the inner floor of the cell container 12 to prevent the generation of hydrogen gas beneath the anode compartment 36.

Referring now specifically to FIG. 2 and where the electrode assembly is again denoted generally at 40. The main anode body 80 comprises hard carbon in the form of a generally rectangular flat plate. The upper portion 82 of the anode body 80 is roughened by abrasion such as grit-blasting, for example. The roughened portion 82 is coated with pitch, in this case by dipping, but may be by brushing or spraying, and is allowed to cure/dry for 12 hours. The coated anode is then heated at 5°–10° C./minute up to 500° to 650° C. in a reducing atmosphere for 2 to 3 hours, followed by furnace cooling to ambient temperature. The cooled anode is then drilled and tapped and screwed 84 to a nickel hanger block 86 which has a flexible mild steel anode hanger rod 42 attached thereto. The coated upper portion 82 of the anode, the hanger block 86 and the lower portion of the flexible hanger rod 42 are then sprayed with a nickel coating 88 (the extend indicated by the line 90) by, for example, plasma-spraying. This method of anode preparation has been found to give excellent electrical contact, and is not susceptible to the corrosion problems of known anode constructions.

In alternative anode constructions, the pitch was replaced with either Union Carbide UCAR (Trade mark) grade 34 graphite cement or a mixture of UCAR (Trade mark) graphite cement and crushed isotropic (non-graphitic) porous carbon having a density of 1.15 $gcm^{-3}$. In both cases the applied material was cured on the anode for 4 hours at 100° C. followed by 16 hours at 130° C. The anodes were then fired in a hydrogen atmosphere for 30 minutes at 500° C. followed by cooling to ambient temperature. Subsequent processing was as described as above.

Figure 5A:
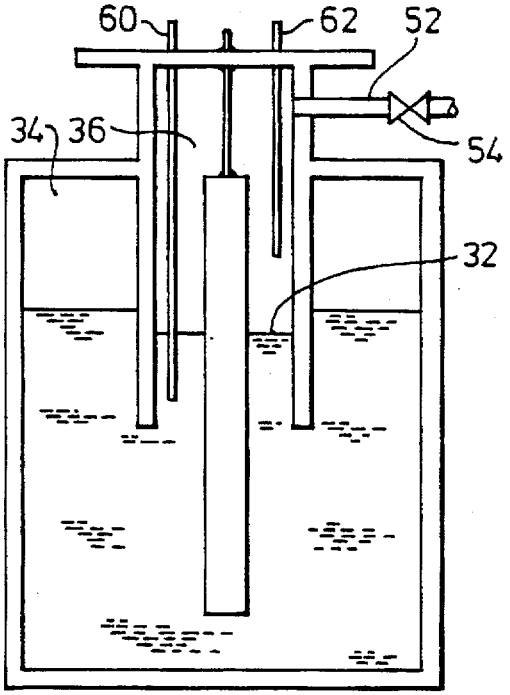
FIGS. 5A to 5D which shows schematically the working of the fluorine cell of FIG. 1 under different conditions.
Figure 5C:
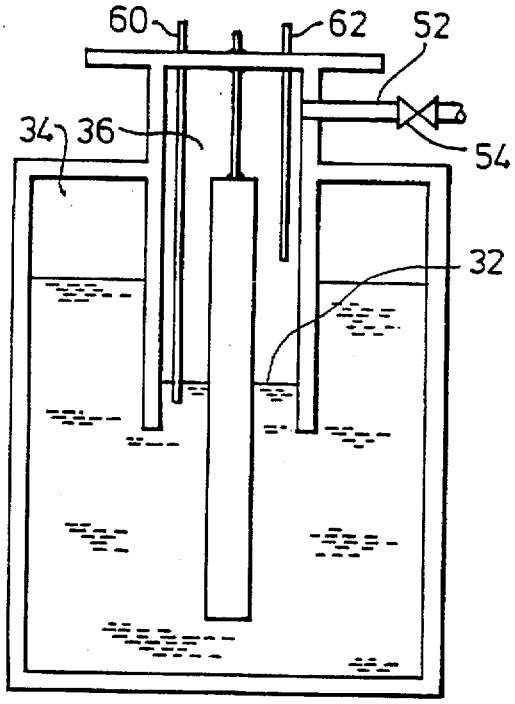
Figure 5B:
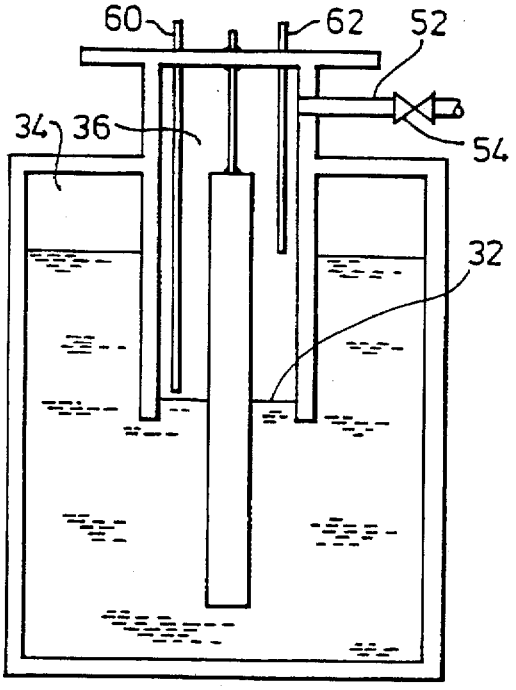
Figure 5D:
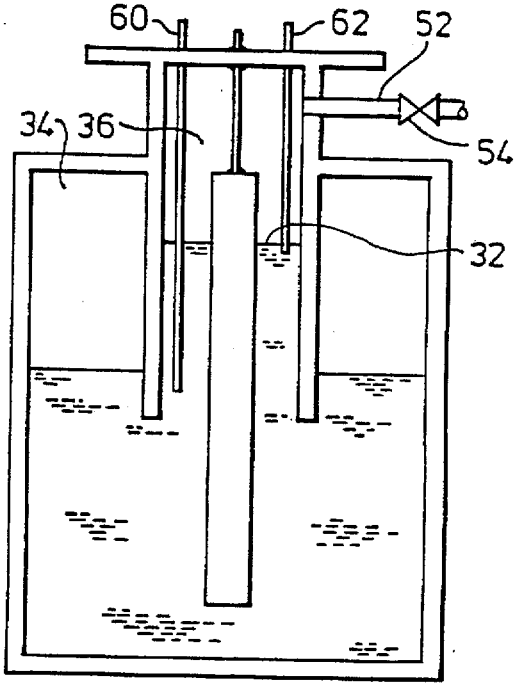

Referring now to FIG. 5A to 5D which show the main features of the cell according to the present invention and where various operating conditions are indicated schematically. The cell provides the ability to produce fluorine gas on demand. The device 66 is set at a current level in excess of that anticipated to supply the required fluorine gas generation rate. In this condition, as shown in FIG. 5A the end of the control probe 60 is below the surface level 32 of the hydrogen fluoride electrolyte 16. In this condition, whilst there is continuity of contact between the probe and the surface 32, electrolysis is continued and fluorine gas is drawn off as required through the conduit 52 and valve 54. Since the rate of withdrawal of fluorine is somewhat less than the set rate of production, the level 32 is slowly depressed by the fluorine gas pressure building up in the anode compartment 36. A point is eventually reached as shown in FIG. 5B where the level 32 is depressed below the end of the probe 60, and since there is no longer continuity between the probe and surface 32, the signal from the probe 60 to the device 66 causes the latter to cease current supply to the electrolysis process and fluorine production stops. When fluorine is again withdrawn from the valve 54, the pressure in the anode compartment begins to fall and the surface level 32 consequently begins to rise, re-establishing contact between the end of the probe 60 and the surface 32, at which point the device 66 is signalled to start the current supply again as indicated in FIG. 5C. All the time fluorine is being generated in the anode compartment 36, hydrogen is being generated in the cathode compartment 34, the hydrogen being either vented, used or otherwise disposed off through the conduit 56 and valve 58 in a controlled manner. However, if for some reason the hydrogen is not vented or otherwise disposed of, the gas pressure in the cathode compartment 34 will rise forcing the level 32 in the anode compartment 36 upwardly towards the probe 62. At the point where the level 32 touches the end of the probe 62, the device 66 will receive a signal to terminate the current supply so as to stop electrolysis as indicated in FIG. 5D. Thus, the probes 60, 62 form fail-safe safety controls against either over-production and under-utilisation of either gas or as a safety measure against apparatus failures. It will be further noted that at no time does the anode become uncovered by the electrolyte being always at least partially immersed therein.

The apparatus may be constructed so as to produce fluorine at a relatively constant pressure by arranging for the depth of skirt penetration into the electrolyte to be at a precise level and for the height difference between the electrolyte in the anode and cathode compartments to be controlled by the depth setting of the probe 60. The cell is then run so that it is producing substantially more than the anticipated demand and the surface level 32 is effectively running constantly as shown in FIG. 5B.

We claim:

1. A fluorine cell for the production of fluorine, the fluorine cell comprising: a cell container for containing an electrolyte, a cathode compartment and an anode compartment, the electrolyte having a surface level, the anode compartment having an anode therein, the cathode compartment and the anode compartment having separation means therebetween so as to separate fluorine gas and hydrogen gas generated during operation of said fluorine cell but said separation means allowing passage of the electrolyte, when present, between said compartments; said anode extending below a lower end of the separation means and, in use, being adapted for continuous contact with the electrolyte; wherein said cell has control sensor means in at least one of said anode or cathode compartments adapted to sense the surface level of the electrolyte in said at least one compartment when the electrolyte is present; and electric current supply means responsive to signals from said control sensor means so as to either start or stop current supply in accordance with said signals so as to start or stop electrolysis of the electrolyte, when present, respectively.

2. A cell according to claim 1 wherein the separation means is a skirt member which is adapted to extend below the surface level of the electrolyte within the cell, when the electrolyte is present, under all operating conditions such that in use there are produced as a result of electrolysis of the electrolyte two separate compartments, an anode compartment for receiving fluorine and a cathode compartment for receiving hydrogen, above the electrolyte surface level when in the separate compartments.

3. A cell according to claim 2 wherein the separate compartments are closed and have means for communicating therewith to allow, in use, either fluorine or hydrogen or both gases to be vented or extracted as desired.

4. A cell according to claim 1 further including heating means so as to be able to heat the electrolyte to render it molten.

5. A cell according to claim 1 wherein the control sensor means comprises a probe which extends into the anode compartment and produces a signal in response to the surface level of the electrolyte when the electrolyte is present.

6. A cell according to claim 5 wherein the probe is selected from the group comprising electrical continuity probes, electrical contact probes, capacitance transducers and optical transducers to read the electrolyte level.

7. A cell according to claim 1 wherein, in use, a fixed pressure of fluorine is maintained by said control sensor means responding to a relationship between a control sensor setting and a difference in surface levels of the electrolyte in the anode compartment and in the cathode compartment, when the electrolyte is present.

8. A cell according to claim 1 wherein there is provided a second control sensor means to detect a maximum electrolyte surface level in the anode compartment when the electrolyte is present.

9. A cell according to claim 1 wherein the control sensor means are situated either within the anode compartment or within the cathode compartment so as to read electrolyte surface level when electrolyte is present.

10. A fluorine cell for the production of fluorine according to claim 1 wherein the anode includes a carbon anode portion, said carbon anode portion having a metallic hanger portion attached thereto by fixing means, said anode also having a coating of a metal applied over at least an area covering a junction between said carbon anode portion and said hanger portion.

11. A flourine cell according to claim 1 and having an anode mounting arrangement comprising an anode portion having flexible hanger means connected thereto, said flexible hanger means being connected to a wall of said anode compartment so as to allow movement between said anode and the walls of said anode compartment; and electrically insulating guide members interposed between said anode and said walls.

12. An anode mounting arrangement within an anode compartment of a fluorine cell, the arrangement comprising an anode portion having flexible hanger means connected thereto, said flexible hanger means being connected to a wall of said anode compartment so as to allow movement between said anode and the walls of said anode compartment; and electrically insulating guide members interposed between said anode and said walls; wherein the flexible hanger means is connected directly to an inner surface of the wall of the anode compartment without extending through the wall of the anode compartment.

13. An anode mounting arrangement according to claim 12 wherein the flexible hanger means is connected to the wall of the anode compartment by a welded joint.

14. An anode mounting arrangement according to claim 12 wherein the electrically insulating guide members comprise fluoro-plastics materials.

15. An anode mounting arrangement according to claim 12 wherein the guide members are attached to the wall or walls of the anode compartment.

* * * * *